US006836939B2

(12) United States Patent
Guirman et al.

(10) Patent No.: US 6,836,939 B2
(45) Date of Patent: Jan. 4, 2005

(54) METHOD AND DEVICE FOR PRODUCING A TEXTILE WEB BY SPREADING TOWS

(75) Inventors: Jean-Michel Guirman, Begles (FR); Bernard Lecerf, Gradignan (FR); Alain Memphis, Merignac (FR)

(73) Assignee: SNECMA Propulsion Solide, Le Haillan Cedex (FR)

( * ) Notice: Subject to any disclaimer, the term of this patent is extended or adjusted under 35 U.S.C. 154(b) by 120 days.

(21) Appl. No.: 10/362,746

(22) PCT Filed: Jun. 28, 2002

(86) PCT No.: PCT/FR02/02249

§ 371 (c)(1),
(2), (4) Date: Feb. 27, 2003

(87) PCT Pub. No.: WO03/004744

PCT Pub. Date: Jan. 16, 2003

(65) Prior Publication Data

US 2003/0172506 A1 Sep. 18, 2003

(30) Foreign Application Priority Data

Jun. 29, 2001 (FR) ..... 01 08646

(51) Int. Cl.[7] ..... D01D 11/02
(52) U.S. Cl. ..... 28/283; 28/282
(58) Field of Search ..... 28/283, 282, 271, 28/281, 220, 167, 178; 19/66 T, 66 R, 65 T; 226/7, 97.1, 97.3, 97.4; 264/211.14, 69, 70, 555

(56) References Cited

U.S. PATENT DOCUMENTS 2,778,065 A 1/1957 Doleman
3,273,328 A 9/1966 Bloch
3,286,307 A 11/1966 Watson
3,423,795 A * 1/1969 Watson ..... 19/66 T (List continued on next page.)

FOREIGN PATENT DOCUMENTS

FR 1 418 403 A 11/1965
GB 1 253 546 A 11/1971
GB 1 425 032 2/1976

OTHER PUBLICATIONS

* Patent Abstracts of Japan, vol. 014, No. 123 (C–0698), Mar. 8, 1990 & JP 01 321944 A (Toray Ind Inc.) Dec. 27, 1989; abstract.

* Patent Abstracts of Japan, vol. 1999, No. 11, Sep. 30, 1999 & JP 11 172562 A (Fukui Prefecture), Jun. 29, 1999; abstract.

* Database WPI, Section CH, Week 197521; Derwent Publications Ltd., London, GB; Class F04, AN 1975–35261W (XP002195728) & JP 50 010962 B (Teijin Ltd.), Apr. 25, 1975; abstract.

*Primary Examiner*—Amy B. Vanatta
(74) *Attorney, Agent, or Firm*—Weingarten, Schurgin, Gagnebin & Lebovici LLP

(57) ABSTRACT

After yarns or tows (10) have been pre-spread and placed side by side substantially in a common plane, their surface is swept by at least one jet of air (22) displaced transversely relative to the longitudinal direction of the yarns or tows so as to obtain a substantially unidirectional sheet (20) that is uniform.

16 Claims, 3 Drawing Sheets

U.S. PATENT DOCUMENTS

| | | | | | |
|---|---|---|---|---|---|
| 3,523,059 | A | * | 8/1970 | Coates | 442/352 |
| 3,566,451 | A | * | 3/1971 | Weigand | 28/283 |
| 3,660,867 | A | * | 5/1972 | Watson | 19/163 |
| 3,795,944 | A | | 3/1974 | Daniels | |
| 3,873,389 | A | | 3/1975 | Daniels | 156/181 |
| 3,945,545 | A | * | 3/1976 | Bacro | 226/97.4 |
| 4,179,776 | A | | 12/1979 | Wortman | 28/121 |
| 5,042,122 | A | | 8/1991 | Iyer et al. | |
| 5,060,351 | A | * | 10/1991 | Street | 28/283 |
| 5,446,952 | A | | 9/1995 | Kim et al. | 28/283 |
| 5,762,759 | A | * | 6/1998 | Wedel | 162/193 |
| 6,032,342 | A | * | 3/2000 | Kawabe et al. | 28/283 |
| 6,105,222 | A | * | 8/2000 | Fleissner | 28/104 |
| 6,253,431 | B1 | * | 7/2001 | Ames et al. | 28/283 |
| 6,343,410 | B2 | * | 2/2002 | Greenway et al. | 28/104 |
| 6,543,106 | B1 | * | 4/2003 | Ames et al. | 28/283 |
| 6,684,468 | B1 | * | 2/2004 | Lujan | 28/103 |

* cited by examiner

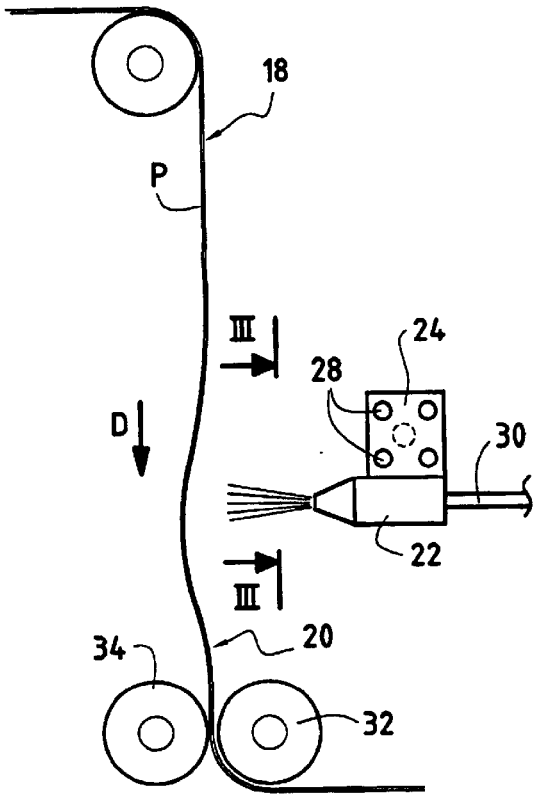
FIG.2
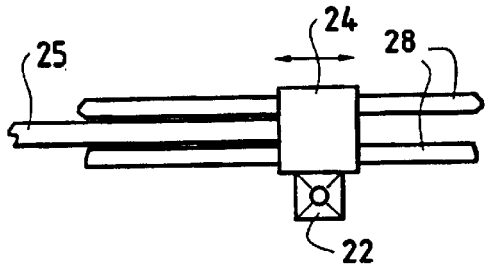
FIG.3
FIG.4
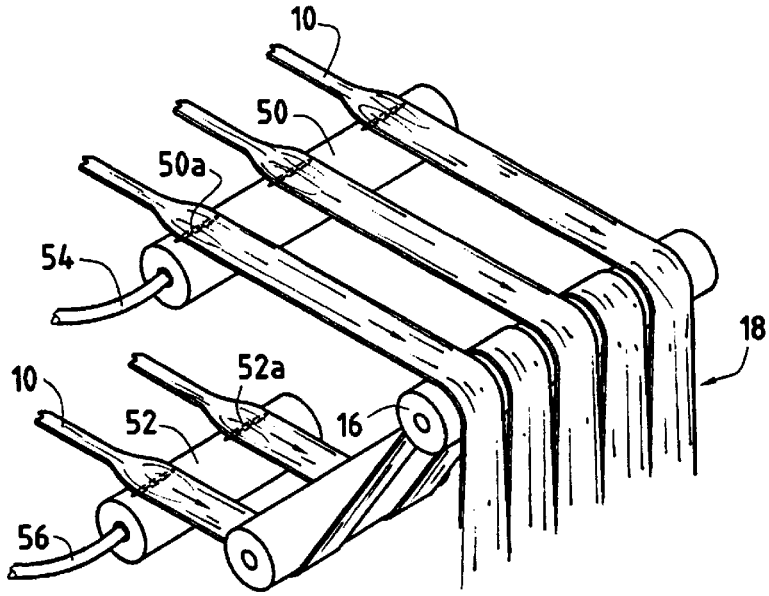

METHOD AND DEVICE FOR PRODUCING A TEXTILE WEB BY SPREADING TOWS

This application is a 371 national phase of PCT/FR02/02249 filed Jun. 28, 2002, and claims priority to a French application No. 01 08646 filed Jun. 29, 2001.

BACKGROUND OF THE INVENTION

The invention relates to making uniform fiber sheet by spreading out tows, such sheets being used in particular for making the reinforcement of composite material parts.

In order to make unidirectional fiber sheets of relatively large width, it is well known to spread out a plurality of yarns or tows and to juxtapose the spread-out yarns or tows. Spreading out can be performed by passing over curved bars (or "banana" bars) or by passing through an air spreader.

Unidirectional sheets made in that way can be superposed in different directions and bonded to one another, for example by needling, in order to form multidirectional sheets. They may also be bonded, e.g. likewise by needling, with other types of fiber fabric, in particular woven cloth, so as to constitute complex or laminated fiber fabrics that are essentially two-directional.

In order to reduce the costs of making fiber sheets, and in particular when the fibers are carbon fibers, it is desirable to use as raw material the thick yarns or tows that are commercially available and of price per unit weight that is significantly lower than that of thinner yarns.

Nevertheless, the Applicant has found that it is more difficult to make uniform sheets by spreading thick yarns or tows and juxtaposing the spread yarns or tows than when using thinner yarns. Discontinuities (overlaps or gaps) are difficult to avoid at the junctions between spread-out yarns or tows.

OBJECTS AND SUMMARY OF THE INVENTION

An object of the invention is to remedy that drawback and for this purpose the invention provides a method of making a uniform fiber sheet by spreading and juxtaposing yarns or tows, in which method, after the yarns or tows have been pre-spread and placed side by side substantially in a common plane, their surface is swept by at least one jet of air moved transversely relative to the longitudinal direction of the yarns or tows in such a manner as to obtain a substantially unidirectional sheet that is uniform.

Advantageously, the jet of air is displaced back and forth from one side to the other of the set of yarns or tows placed side by side, while they are being displaced in a longitudinal direction.

Preferably, the jet of air is directed substantially perpendicularly to the plane of the yarns or tows.

The method of the invention confers uniformity to the unidirectional sheet by causing the filaments constituting the yarns or tows to vibrate by sweeping them with the jet of air. Additional spreading of the yarns or tows may be performed during this sweeping operation.

The sheet is preferably maintained, and least temporarily, in the state in which it is to be found after it has been swept by the jet of air. This is advantageously achieved by passing over a roller, which at least in its portion that comes into contact with the sheet, is made of a material that presents a coefficient of friction that opposes sliding of the filaments that might lead to the sheet narrowing or to discontinuities. By way of example, such a material may be rubber or foam.

The invention also provides an installation enabling the method to be implemented, the installation being of the type comprising at least one device for pre-spreading yarns or tows, and means for driving the yarns or tows side by side downstream from the pre-spreading device.

According to the invention, the installation further comprises at least one device for sweeping by means of a jet of air, the device being placed beside a path of the yarns or tows downstream from the pre-spreading device, a duct for feeding the sweeping device with air under pressure, and a drive member for driving the sweeping device transversely relative to said path.

BRIEF DESCRIPTION OF THE DRAWINGS

The invention will be better understood on reading the following description given by way of non-limiting indication and with reference to the accompanying drawings, in which:

FIG. 2 is a side elevation view on a larger scale of the device in the FIG. 1 installation for sweeping by means of an air jet;

FIG. 3 is an elevation view in plane III—III of FIG. 2;

FIG. 4 is a fragmentary view showing a variant embodiment of the FIG. 1 installation.

DETAILED DESCRIPTION OF EMBODIMENTS

Figure 1:
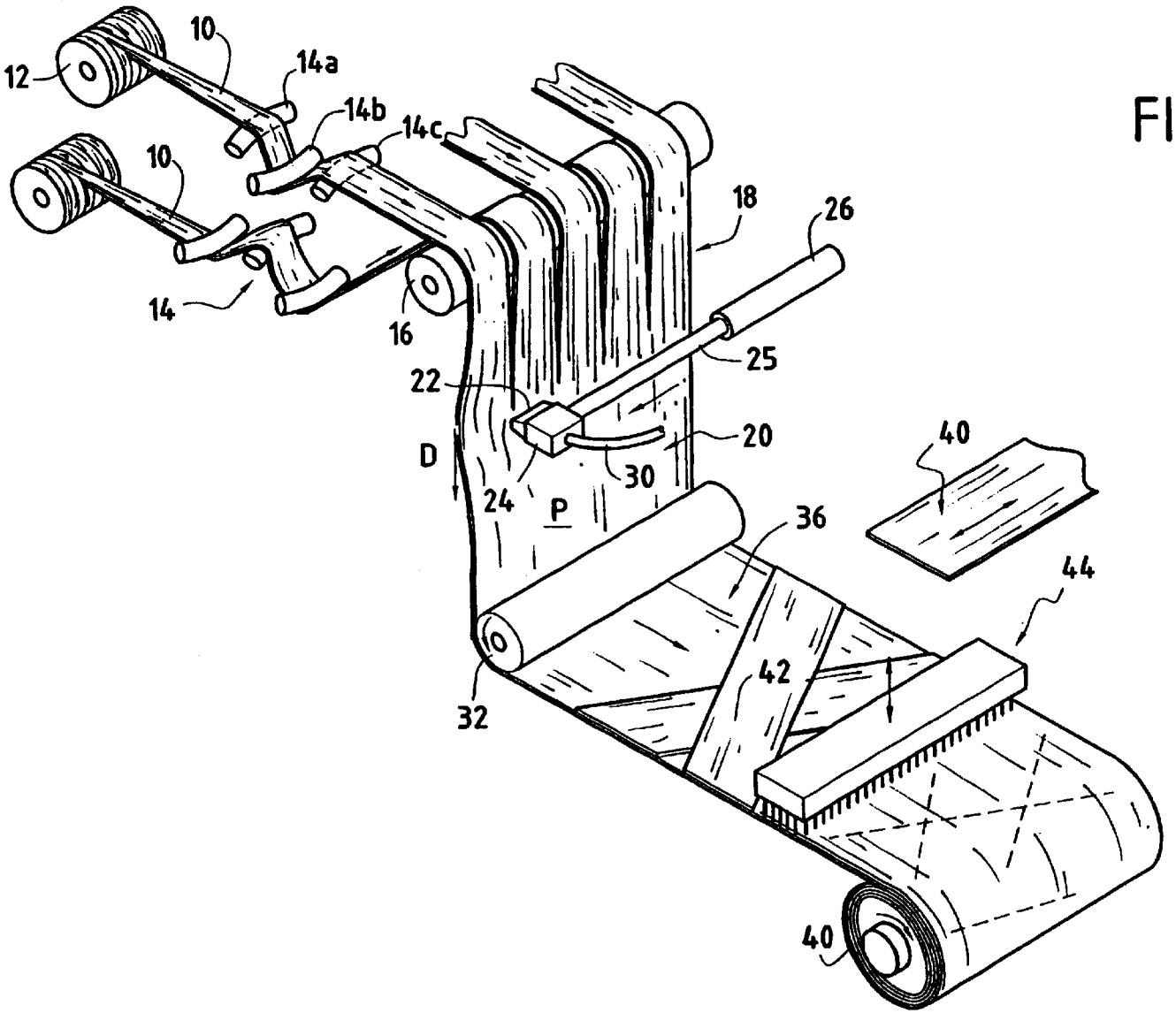
FIG. 1 is a highly diagrammatic view of an embodiment of an installation in accordance with the invention.

In the installation of FIGS. 1 to 3, a plurality of tows 10 drawn from spools 12 are opened and pre-spread by passing over curved bars 14. In the example shown, each tow 10 passes over a succession of bars 14*a*, 14*b*, 14*c*, coming into contact with generator lines of the bars on their convex sides.

The pre-spread tows 10 are placed side by side on a roller 16 from which they follow a substantially vertical downward path.

Along this path, the set 18 of tows 10 placed side by side is exposed to sweeping by means of a jet of air in a direction extending transversely relative to the travel direction D of the tows. The sweeping direction is advantageously perpendicular to the direction D, i.e. in this case substantially horizontal. In addition, the sweeping direction is substantially parallel to the plane P formed by the set of tows 10.

The sweeping is produced by means of an air ejection nozzle 22 carried by a support 24. The support is fixed to the end of the rod 25 of an actuator 26 and it is guided in its horizontal displacement by means of stationary horizontal rods 28 (visible only in FIGS. 2 and 3) extending parallel to the plane P and on which the support 24 is engaged. A flexible hose 30 brings air under pressure to the nozzle 22.

By way of example, the actuator 26 is a pneumatic actuator. It is controlled in such a manner as to impart reciprocating linear motion in translation to the nozzle 22 from one side of the set 18 of tows 10 to the other.

Other guides could be used for moving the nozzle in reciprocating horizontal motion. For example, the support 22 could be secured to an endless belt passing over a drive roller and a return roller at the ends of the stroke of the nozzle 22, the drive roller being coupled to a motor that is driven alternately in one direction and then in the other.

After sweeping by means of the jet of air, a uniform sheet 20 is obtained. This passes over at least one roller 32 which, at least in its portion that comes into contact with the sheet, is made out of a material presenting friction characteristics such as to oppose any lateral sliding of the filaments in order to conserve both the width of the sheet and its uniformity, at least on a temporary basis, until subsequent fixing. By way of example, this material is a rubber or a foam of plastics material. Adhesion between the roller 32 and the filaments of the sheet must nevertheless remain limited so as to avoid the roller 32 entraining filaments away from the sheet.

On its path between the roller 16 and the roller 32, the sheet 20 is free. The tension in the sheet can be defined merely by the sheet being drawn downstream from the roller 32 against the weight of the individual spools 12.

As shown diagrammatically in FIG. 2, the jet of air produced by the nozzle 22 deforms the sheet 20 so that it departs a little from the plane P. This deformation is accompanied by the filaments constituting the tows by vibrating over the free path of the sheet between the rollers 16 and 32, thus encouraging these filaments to take up a substantially uniform distribution over the width of the sheet, in combination with the lateral displacement of the nozzle 22.

A uniform and substantially unidirectional sheet 20 is obtained, even when the pre-spread tows 10 are not placed initially so as to be exactly adjacent to one another in the set 18. FIG. 1 shows the pre-spread tows 10 leaving gaps between the tows on the roller 16. It is the sweeping by means of the jet of air that finishes off the spreading out of the tows. The sweeping may also be used to widen the sheet 20 relative to the total width of the set 18.

Naturally, the sweeping of the sheet 20 by the jet of air continues to be effective in making the sheet uniform even when care is taken to ensure that the tows 10 are placed on the roller 16 without any gaps between them.

The passage over the roller 32 contributes to keeping the filaments of the sheet in their relative positions, and thus to maintain the uniform distribution of the sheet.

After passing over the roller 32, the sheet 20 can be taken to a web-forming station 36 fed with a unidirectional sheet 40 which is secured continuously to the steadily traveling sheet 20 so as to obtain a three-directional sheet 42. The various layers making up the sheet 42 may be bonded together by light needling in a needling station 44, and the resulting sheet may be stored on a take-up roller 46. Such building up of a multidirectional sheet by superposing unidirectional sheets in different directions and needling them together is well known.

It need not be necessary for the tows 10 to be pre-spread or pre-opened prior to being made uniform and being spread out by being swept by a jet of air, however such pre-spreading or pre-opening is usually preferable in order to separate the filaments of the tows from one another, since they can be stuck together to a greater or lesser extent due to oiling.

FIG. 4 shows a variant embodiment in which the pre-spreading of the tows 10 is performed by being passed over a slit tube.

In the example shown, the tows 10 are initially separated into two groups. Every other tow passes over a first tube 50 upstream from the roller 16, while the other tows pass over a second tube 52, likewise upstream from the roller 16.

Each tube 50, 52 is provided with slits 50*a*, 52*a* formed through the tube wall and extending over a limited length parallel to the axis of the tube.

The slits may be made by laser cutting.

The tubes 50, 52 are closed at one end and they are fed at their opposite end with air under pressure by means of pipes 54, 56.

Each tow 10 passes over a slit 50*a*, 52*a*, with the tubes 50, 52 extending perpendicularly to the paths followed by the tows 10.

The jet of air issuing through each slit causes the facing tow to be spread out.

It is possible to cause the tows to pass over a common slit tube, but the slits and consequently the pre-spread tows must be spaced far enough apart to ensure that the jet of air for spreading out one tow does not interfere with the spreading out of an adjacent tow.

Figure 5:
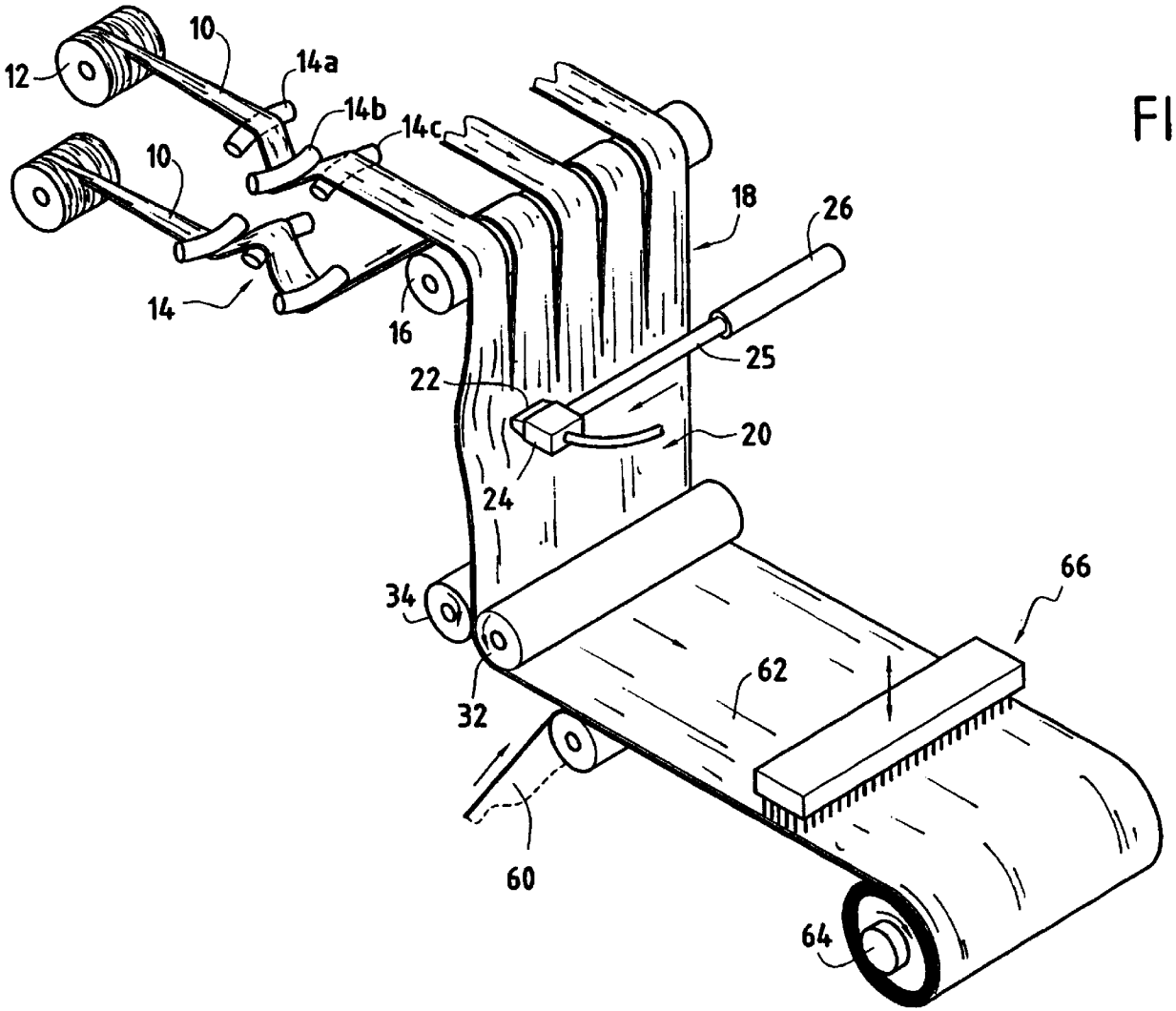
FIG. 5 is a fragmentary view showing another variant of the FIG. 1 installation.

FIG. 5 shows another variant embodiment in which the sheet 20, after passing between the rollers 32 and 34 is superposed on a fiber fabric 60 that is fed separately, e.g. a strip of woven cloth. The complex structure 62 formed by the sheet 20 and the cloth 60 is wound onto a mandrel 64 so as to form an annular cylindrical fiber preform. The fiber layers superposed on the mandrel 64 may be bonded together by means of needling using a needle board 66 extending along a generator line of the mandrel and driven with reciprocating motion in a radial direction.

The invention is remarkable in that it uses means which are simple and inexpensive to build up a uniform sheet from a plurality of spread tows. The method is preferably implemented using thick tows. For example, uniform unidirectional sheets of carbon fibers have been successfully obtained of width lying in the range 30 centimeters (cm) to 50 cm using 48 K carbon tows (i.e. tows having 48,000 filaments) sold under the reference "Panex 35-48K" by the US supplier "ZOLTEK".

What is claimed is:

1. A method of making a fiber sheet by spreading and juxtaposing yarns or tows, the method being characterized in that after the yarns or tows have been pre-spread and placed side by side substantially in a common plane, their surface is swept by at least one jet of air moved transversely relative to the longitudinal direction of the yarns or tows in such a manner as to obtain a substantially unidirectional sheet that is uniform.

2. A method according to claim 1, characterized in that the jet of air is displaced back and forth from one side to the other of the set of yarns or tows placed side by side, while they are being displaced in a longitudinal direction.

3. A method according to claim 1, characterized in that the jet of air is directed substantially perpendicularly to the plane of the yarns or tows.

4. A method according to claim 1, characterized in that additional spreading of the yarns or tows is achieved by the sweeping by the jet of air.

5. A method according to claim 1, characterized in that after being swept by the jet of air, the resulting sheet passes over a roller which, at least in its portion that comes into contact with the sheet, is made of a material presenting a coefficient of friction that opposes sliding of the filaments making up the sheet so as to maintain it in a spread-out form.

6. A method according to claim 2, characterized in that the jet of air is directed substantially perpendicularly to the plane of the yarns or tows.

7. A method according to claim 2, characterized in that additional spreading of the yarns or tows is achieved by the sweeping by the jet of air.

8. A method according to claim 3, characterized in that additional spreading of the yarns or tows is achieved by the sweeping by the jet of air.

9. A method according to claim 2, characterized in that after being swept by the jet of air, the resulting sheet passes over a roller which, at least in its portion that comes into contact with the sheet, is made of a material presenting a coefficient of friction that opposes sliding of the filaments making up the sheet so as to maintain it in a spread-out form.

10. A method according to claim 3, characterized in that after being swept by the jet of air, the resulting sheet passes over a roller which, at least in its portion that comes into contact with the sheet, is made of a material presenting a coefficient of friction that opposes sliding of the filaments making up the sheet so as to maintain it in a spread-out form.

11. A method according to claim 4, characterized in that after being swept by the jet of air, the resulting sheet passes over a roller which, at least in its portion that comes into contact with the sheet, is made of a material presenting a coefficient of friction that opposes sliding of the filaments making up the sheet so as to maintain it in a spread-out form.

12. A method according to claim 8, characterized in that after being swept by the jet of air, the resulting sheet passes over a roller which, at least in its portion that comes into contact with the sheet, is made of a material presenting a coefficient of friction that opposes sliding of the filaments making up the sheet so as to maintain it in a spread-out form.

13. An installation for marking a fiber sheet, the installation comprising at least one device for pre-spreading yarns or tows, and means for driving the yarns or tows side by side downstream from the pre-spreading device, the installation being characterized in that it further comprises at least one device for sweeping by means of a jet of air from a nozzle device, the device being placed beside a path of the yarns or tows downstream from the pre-spreading device, a duct for feeding the device with air under pressure, and a drive member for driving the sweeping device transversely relative to said path.

14. An installation according to claim 13, characterized in that the pre-spreading device comprises at least one tube with at least one slit formed in a direction that is substantially longitudinal in the wall of the tube, and means for feeding the tube with air under pressure.

15. An installation according to claim 13, characterized in that it further comprises, downstream from the sweeping device, at least one roller placed on the path of the sheet and constituted, at least in its portion in contact with the sheet, by a material selected from a foam and a rubber.

16. An installation according to claim 14, characterized in that it further comprises, downstream from the sweeping device, at least one roller placed on the path of the sheet and constituted, at least in its portion in contact with the sheet, by a material selected from a foam and a rubber.

* * * * *

UNITED STATES PATENT AND TRADEMARK OFFICE

CERTIFICATE OF CORRECTION

PATENT NO. : 6,836,939 B2
DATED : January 4, 2005
INVENTOR(S) : Jean-Michel Guirman et al.

It is certified that error appears in the above-identified patent and that said Letters Patent is hereby corrected as shown below:

Title page, Item [54] and Column 1, lines 1 and 2,
Title, "METHOD AND DEVICE FOR PRODUCING A TEXTILE WEB BY SPREADING TOWS" should read -- METHOD AND APPARATUS FOR MAKING A FIBER SHEET BY SPREADING OUT TOWS --.

Signed and Sealed this

Third Day of January, 2006

JON W. DUDAS
*Director of the United States Patent and Trademark Office*